US009423202B1

(12) United States Patent
Obteshka et al.

(10) Patent No.: US 9,423,202 B1
(45) Date of Patent: Aug. 23, 2016

(54) CABLE ARRANGEMENT FOR A COMPOUND ARCHERY BOW

(71) Applicant: BowTech, Inc., Eugene, OR (US)

(72) Inventors: Nicholas C. Obteshka, Springfield, OR (US); John T. Hernandez, Eugene, OR (US); Christopher J. Eacker, Eugene, OR (US); Jack B. Smith, Veneta, OR (US)

(73) Assignee: BOWTECH, INC., Eugene, OR (US)

( * ) Notice: Subject to any disclaimer, the term of this patent is extended or adjusted under 35 U.S.C. 154(b) by 0 days.

(21) Appl. No.: 14/797,062

(22) Filed: Jul. 10, 2015

(51) Int. Cl.
*F41B 5/10* (2006.01)
*F41B 5/14* (2006.01)

(52) U.S. Cl.
CPC ..... *F41B 5/105* (2013.01); *F41B 5/10* (2013.01); *F41B 5/1403* (2013.01); *Y10S 124/90* (2013.01)

(58) Field of Classification Search
CPC ..... F41B 5/105; F41B 5/10; Y10S 124/90
USPC ..... 124/23.1, 25.6, 900
See application file for complete search history.

(56) References Cited

U.S. PATENT DOCUMENTS 3,990,425 A * 11/1976 Ketchum ..... F41B 5/10 124/25.6
4,338,910 A * 7/1982 Darlington ..... F41B 5/10 124/25.6
4,340,025 A * 7/1982 Caldwell ..... F41B 5/105 124/23.1
4,461,267 A * 7/1984 Simonds ..... F41B 5/10 124/25.6
4,519,374 A * 5/1985 Miller ..... F41B 5/10 124/25.6
4,541,401 A * 9/1985 Caldwell ..... F41B 5/10 124/25.6
4,686,955 A * 8/1987 Larson ..... F41B 5/10 124/25.6
4,756,296 A * 7/1988 Darlington ..... F41B 5/10 124/25.6
5,368,006 A * 11/1994 McPherson ..... F41B 5/10 124/25.6
5,678,529 A * 10/1997 Larson ..... F41B 5/105 124/25.6
5,782,229 A * 7/1998 Evans ..... F41B 5/105 124/25.6
5,791,322 A * 8/1998 McPherson ..... F41B 5/10 124/25.6
5,960,778 A * 10/1999 Larson ..... F41B 5/10 124/25.6
6,098,607 A * 8/2000 Strother ..... F41B 5/10 124/25.6
6,237,582 B1 * 5/2001 McPherson ..... F41B 5/105 124/25
6,250,293 B1 * 6/2001 Andrews ..... F41B 5/10 124/25.6
6,321,736 B1 * 11/2001 McPherson ..... F41B 5/105 124/25
6,698,413 B1 * 3/2004 Ecklund ..... F41B 5/10 124/23.1
6,871,643 B2 * 3/2005 Cooper ..... F41B 5/10 124/25.6

(Continued)

*Primary Examiner* — Alexander Niconovich
(74) *Attorney, Agent, or Firm* — David S. Alavi

(57) ABSTRACT

As a compound archery bow (binary cam or hybrid cam; having first and second pulley members, a draw cable, and a single, continuous secondary cable) is drawn and its pulley members rotate: (i) both pulley members let out the draw cable; (ii) a take-up pulley of the first pulley member takes up a first end segment of the secondary cable; (iii) a let-out pulley of the second pulley member lets out a portion of an intermediate segment of the secondary cable; and (iv) a take-up pulley of the second pulley member takes up a portion of the intermediate segment of the secondary cable. Engagement of the intermediate segment with the second pulley member substantially prevents slippage of the secondary cable.

19 Claims, 6 Drawing Sheets

(56) References Cited

U.S. PATENT DOCUMENTS 6,976,484 B1 * 12/2005 Gallops, Jr. ..... F41B 5/10 124/25.6
6,990,970 B1 * 1/2006 Darlington ..... F41B 5/10 124/25.6
7,059,315 B2 * 6/2006 Blahnik ..... F41B 5/105 124/25.6
7,143,757 B1 * 12/2006 Cooper ..... F41B 5/10 124/25.6
7,305,979 B1 * 12/2007 Yehle ..... F41B 5/105 124/25.6
7,441,555 B1 * 10/2008 Larson ..... F41B 5/10 124/25.6
8,006,679 B2 * 8/2011 Strother ..... F41B 5/10 124/25.6
8,037,876 B1 * 10/2011 Yehle ..... F41B 5/10 124/25.6
8,156,928 B1 * 4/2012 Blahnik ..... F41B 5/10 124/25.6
8,205,607 B1 * 6/2012 Darlington ..... F41B 5/105 124/23.1
8,220,446 B2 * 7/2012 Batdorf ..... F41B 5/10 124/25.6
8,387,603 B2 * 3/2013 Darlington ..... F41B 5/10 124/23.1
8,443,791 B2 * 5/2013 Miller ..... F41B 5/10 124/25.6
8,522,762 B2 * 9/2013 Trpkovski ..... F41B 5/0094 124/23.1
8,683,989 B1 * 4/2014 McPherson ..... F41B 5/105 124/25.6
8,826,894 B1 * 9/2014 Darlington ..... F41B 5/105 124/25
9,347,730 B2 * 5/2016 Obteshka ..... F41B 5/105

* cited by examiner

CABLE ARRANGEMENT FOR A COMPOUND ARCHERY BOW

FIELD OF THE INVENTION

The field of the present invention relates to compound archery bows. In particular, a cable arrangement is disclosed wherein both pulley members of the bow take up and let out different segments of a single cable.

BACKGROUND

A wide variety of compound archery bows have been developed previously. Some examples are disclosed in:

- U.S. Pat. No. 3,990,425 entitled "Compound bow" issued Nov. 9, 1976 to Ketchum;
- U.S. Pat. No. 4,686,955 entitled "Compound archery bows" issued Aug. 18, 1987 to Larson;
- U.S. Pat. No. 5,368,006 entitled "Dual-feed single-cam compound bow" issued Nov. 29, 1994 to McPherson;
- U.S. Pat. No. 6,871,643 entitled "Eccentric elements for a compound archery bow" issued Mar. 29, 2005 to Cooper et al;
- U.S. Pat. No. 6,990,970 entitled "Compound archery bow" issued Jan. 31, 2006 to Darlington;
- U.S. Pat. No. 7,305,979 entitled "Dual-cam archery bow with simultaneous power cable take-up and let-out" issued Dec. 11, 2007 to Yehle; and
- U.S. Pat. No. 7,441,555 entitled "Synchronized compound archery bow" issued Oct. 28, 2008 to Larson.

SUMMARY

As a compound archery bow (having first and second pulley members, a draw cable, and a single, continuous secondary cable) is drawn and its pulley members rotate: (i) both pulley members let out the draw cable; (ii) a take-up pulley of the first pulley member takes up a first end segment of the secondary cable; (iii) a let-out pulley of the second pulley member lets out a portion of an intermediate segment of the secondary cable; and (iv) a take-up pulley of the second pulley member takes up a portion of the intermediate segment of the secondary cable. To substantially prevent slippage of the secondary cable, the intermediate segment of the secondary cable engages the second pulley member. The bow can be arranged as a binary cam bow (in which a let-out pulley of the first pulley member lets out a second end segment of the secondary cable) or as a hybrid cam bow (in which a second end of the secondary cable is coupled to the first bow limb).

Objects and advantages pertaining to compound archery bows may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Figure 1A:
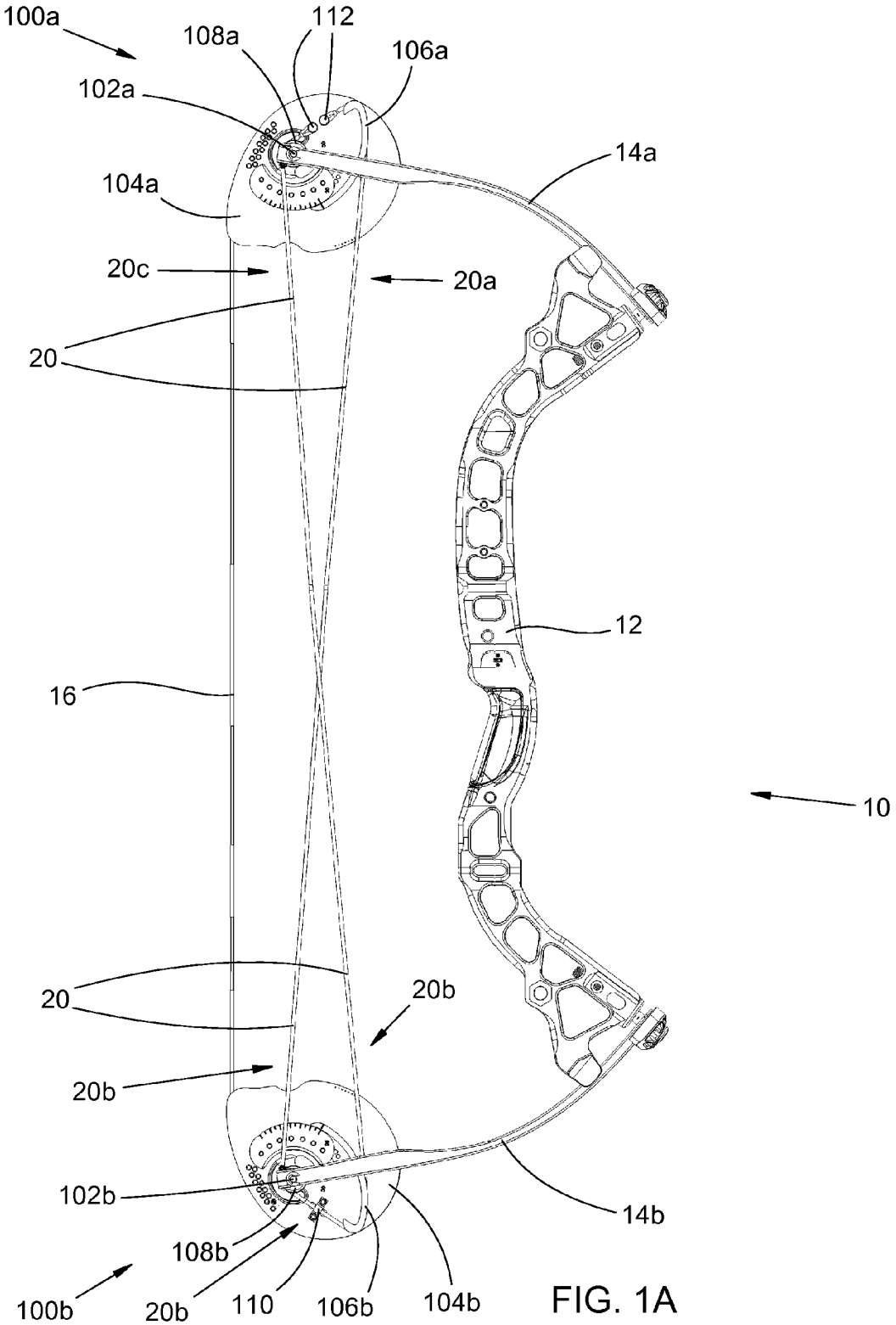
FIGS. 1A and 1B depict schematically a compound archery bow arranged as a binary cam bow at brace and at full draw, respectively.
Figure 1B:
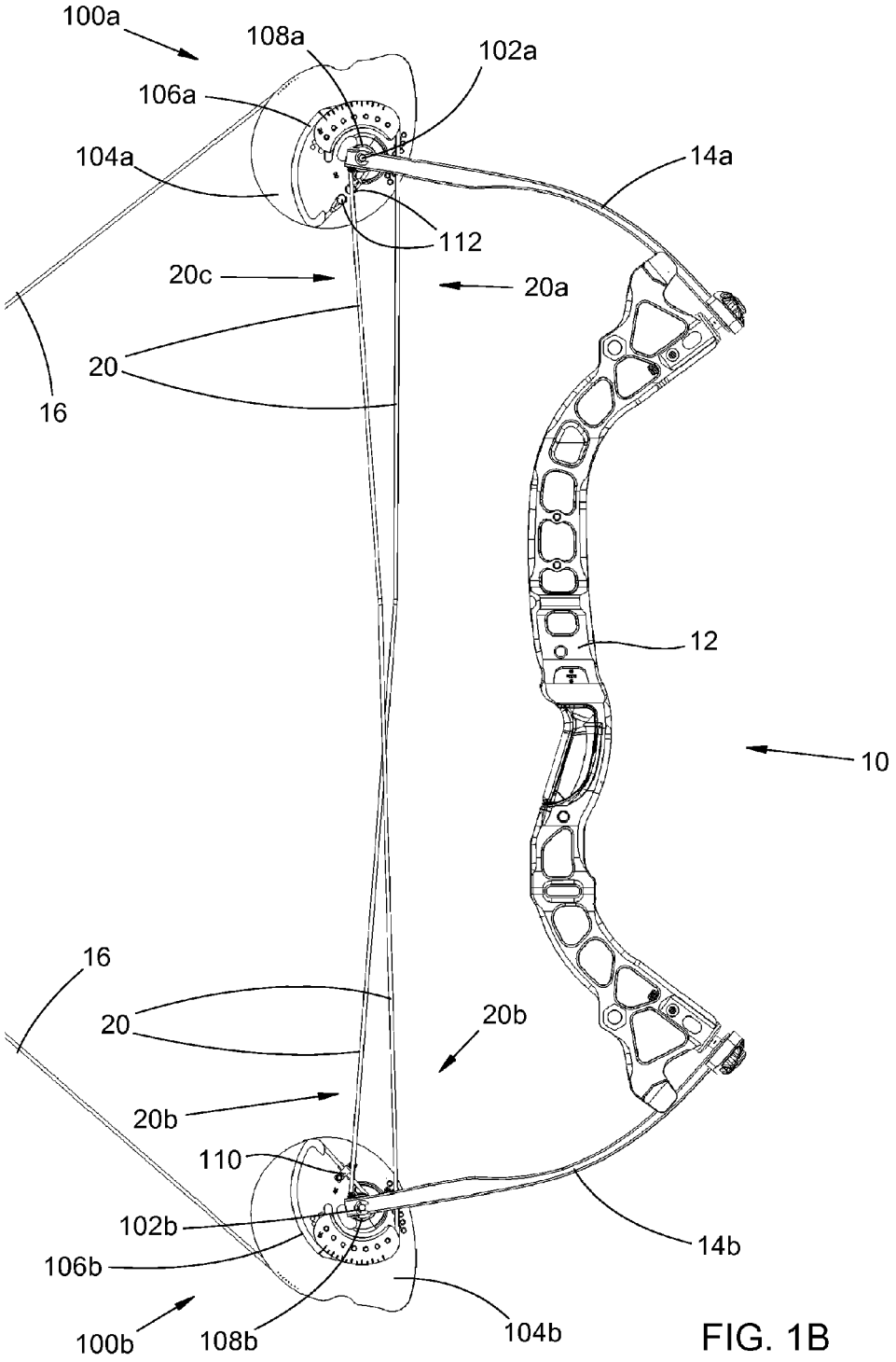
Figure 3A:
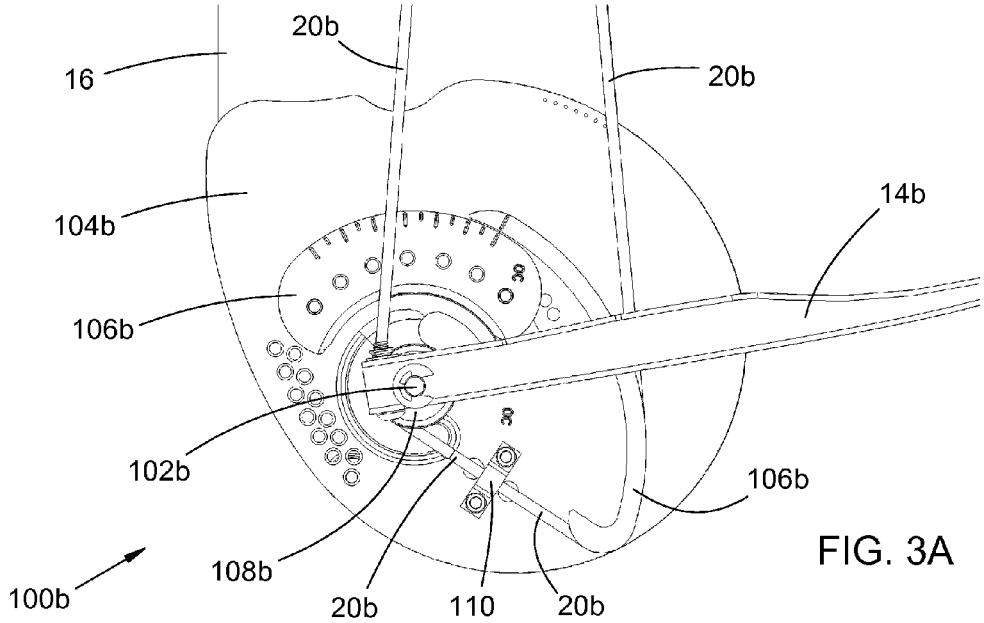
FIGS. 3A and 3B depict schematically a second pulley member of the bow of FIGS. 1A and 1B at brace and at full draw, respectively.
Figure 4A:
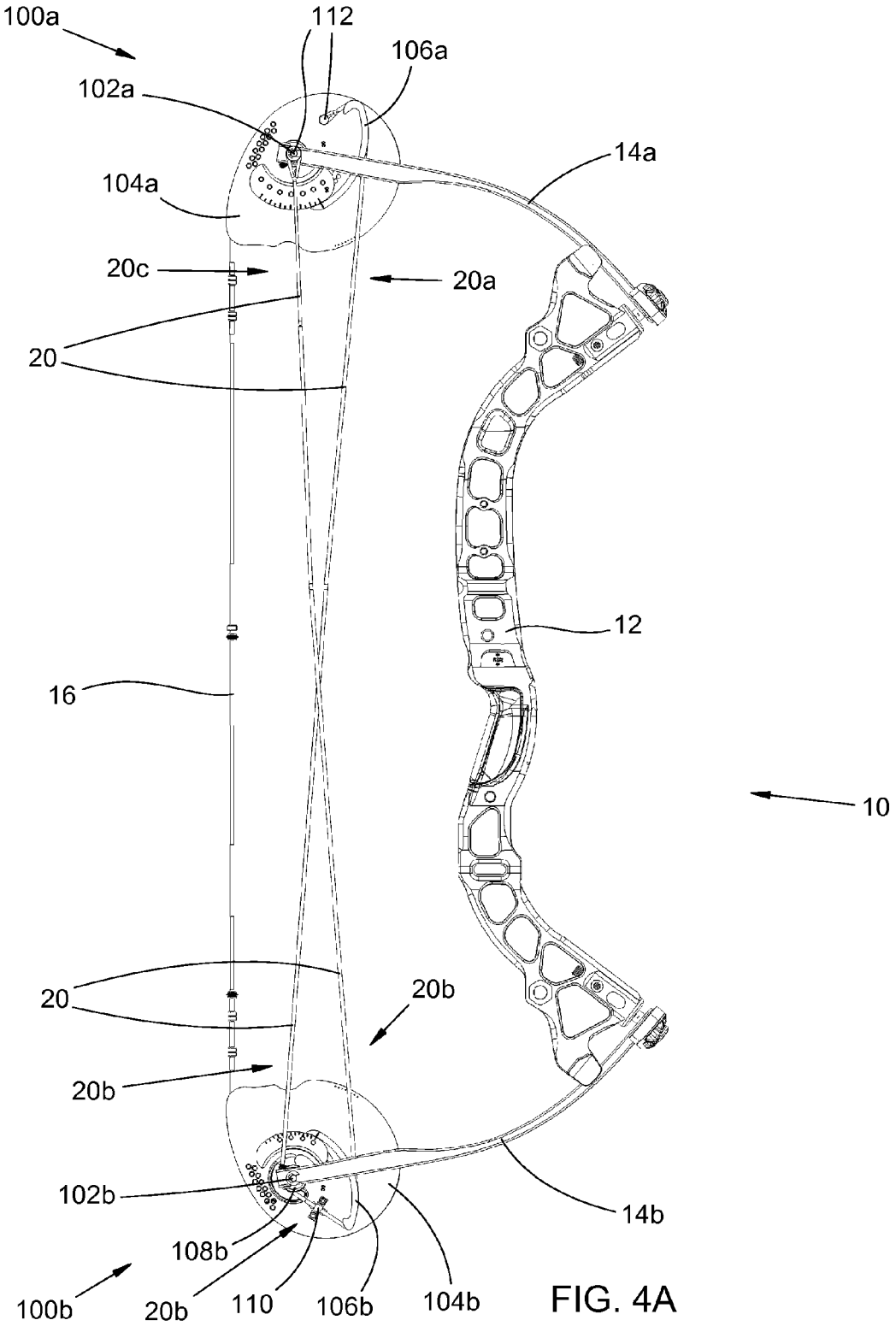
FIGS. 4A and 4B depict schematically a compound archery bow arranged as a hybrid cam bow at brace and at full draw, respectively.
Figure 4B:
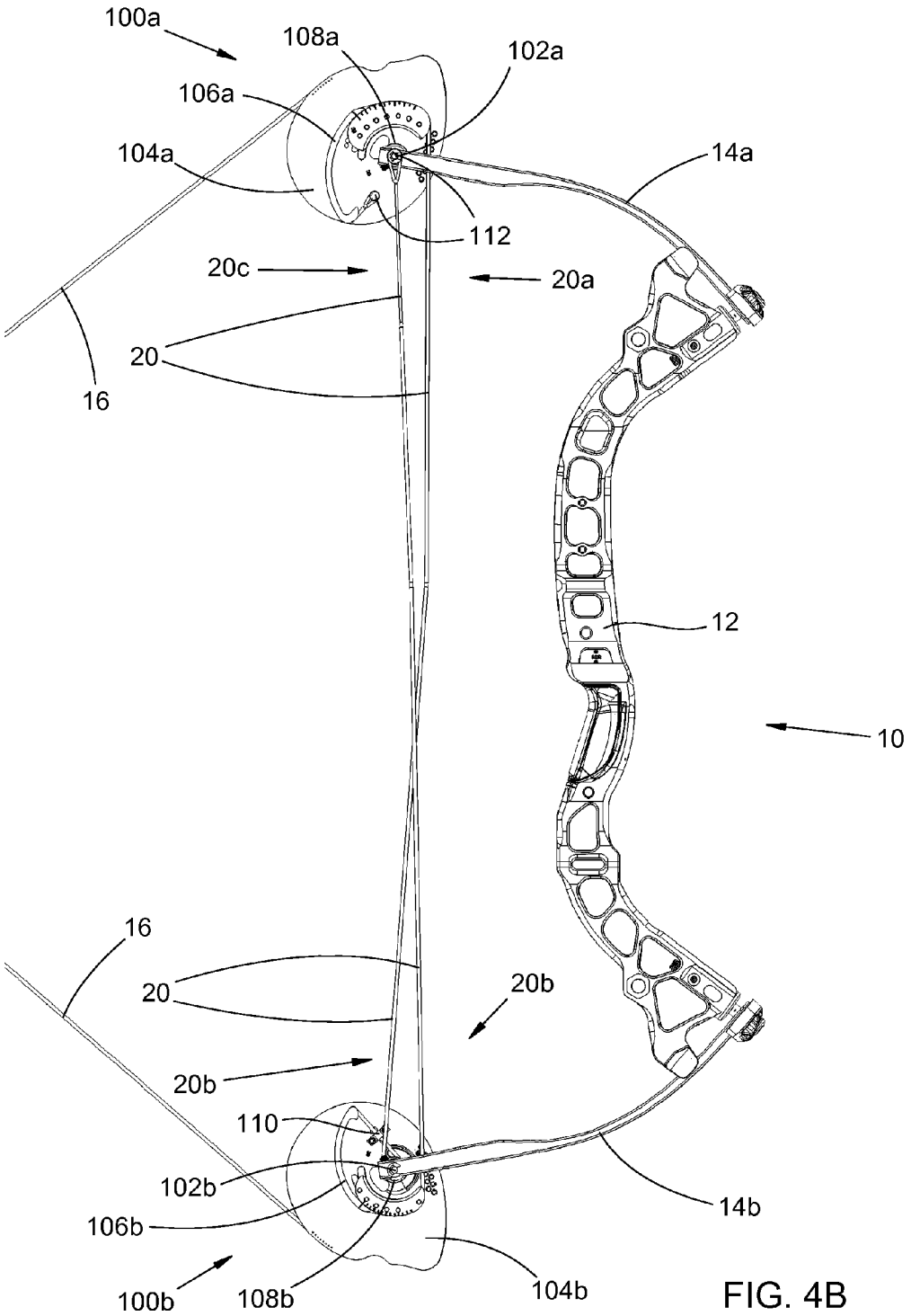

The embodiments depicted are shown only schematically: all features may not be shown in full detail or in proper proportion, certain features or structures may be exaggerated relative to others for clarity, and the drawings should not be regarded as being to scale. The embodiments shown are only examples: they should not be construed as limiting the scope of the present disclosure or appended claims. Note also that the slight bends that appear in the cable 20 in FIGS. 1B and 4B are due to a cable guard of the bow 10 that is not shown so as to simplify the drawings.

DETAILED DESCRIPTION OF EXAMPLE EMBODIMENTS

A compound archery bow 10 comprises a central riser 12, first and second bow limbs 14*a*/14*b* attached to opposing end portions of the riser 12, first and second pulley members 100*a*/100*b* rotatably mounted on the first and second bow limbs 14*a*/14*b*, respectively, a draw cable 16 (i.e., also referred to as the bowstring 16), and a secondary cable 20. The riser and limbs can comprise any one or more suitable materials commonly employed for such purposes, e.g., one or more metals or alloys, one or more composite materials, and so forth. The rotatable mounting of the first and second pulley members 100*a*/100*b* define respective first and second pulley member transverse rotation axes 102*a*/102*b* (transverse with respect to the shooting plane defined by the bow 10 and draw cable 16). The rotatable mounting can be achieved in any suitable way, including use of a transverse axle passing through the pulley member and bow limb, integral axle members laterally protruding from the pulley member and received by the bow limb, rotary bearings of any suitable type or arrangement, and so on.

Each one of the first and second pulley members 100*a*/100*b* includes a corresponding draw cable pulley 104*a*/104*b* and a corresponding take-up pulley 106*a*/106*b*. The second pulley member 100*b* includes a let-out pulley 108*b*; in a binary cam bow (FIGS. 1A through 3B), the first pulley member 100*a* also includes a let-out pulley 108*a*. Each take-up pulley 106*a*/106*b* and let-out pulley 108*a* (if present) and 108*b* is substantially rigidly attached to the corresponding draw cable pulley 104*a*/104*b*. Each pulley member 100*a*/100*b* can comprise separate pulleys assembled together in any suitable way, both or all three pulleys integrally formed together, or two pulleys integrally formed and then assembled in any suitable way with a third pulley. In one common arrangement, the let-out pulley and draw cable pulley are integrally formed and the take-up pulley is assembled with the draw cable pulley, often in one of multiple different positions to allow adjustment of the pulley member. The pulley members 100*a*/100*b* are formed from any one or more suitably strong, suitably rigid materials, e.g., one or more metals or alloys or one or more composite materials. It is common for the pulley assembly to comprise machined, molded, or cast metal or alloy, such as aluminum or steel.

Figure 2A:
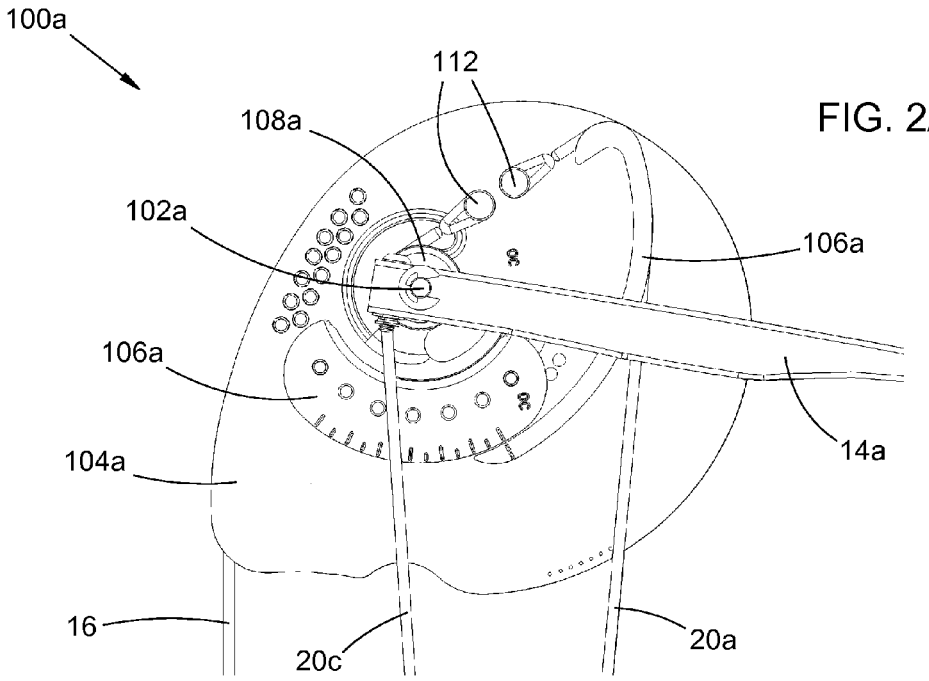
FIGS. 2A and 2B depict schematically a first pulley member of the bow of FIGS. 1A and 1B at brace and at full draw, respectively.
Figure 2B:
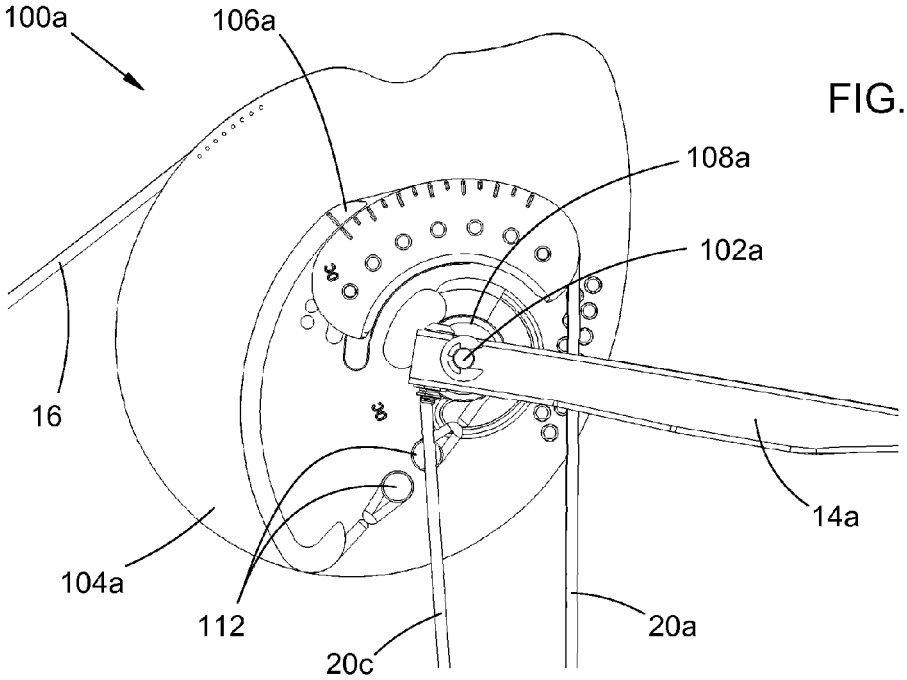

The first pulley member 100*a* is structurally arranged so as to (i) receive a least a portion of a first end segment of the draw cable 16 in a circumferential journal of the first draw cable pulley 104*a* (FIGS. 1A, 2A, and 4A) and let out at least a portion of the first end segment of the draw cable 16 when the bow 10 is drawn (which causes the first pulley member 100*a* to rotate about its pulley member rotation axis 102*a*; FIGS. 1B, 2B, and 4B), (ii) receive at least a portion of a first end segment 20*a* of the secondary cable 20 in a circumferential journal of the first take-up pulley 106*a* (FIGS. 1A, 2A, and 4A) and take up at least a portion of the first end segment 20*a* of the secondary cable 20 when the bow 10 is drawn (FIGS. 1B, 2B, and 4B). In a binary cam bow the first pulley member is further structurally arranged to receive at least a portion of a second end segment 20*c* of the secondary cable 20 in a circumferential journal of the let-out pulley 108*a* (FIGS. 1A and 2A) and let out at least a portion of the second end segment 20*c* of the secondary cable 20 when the bow 10 is drawn (FIGS. 1B and 2B). In a hybrid cam bow, the second end segment 20*c* of the secondary cable is coupled (directly or indirectly) to the first bow limb 14*a* (FIGS. 4A and 4B).

Figure 3B:
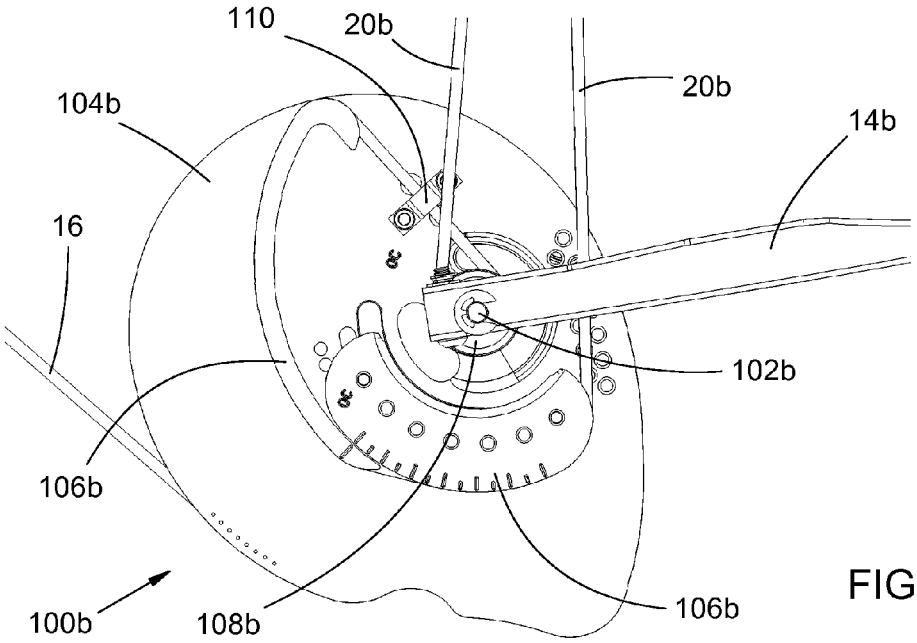

The second pulley member 100*b* is structurally arranged so as to (i) receive at least a portion of a second end segment of the draw cable 16 in a circumferential journal of the second draw cable pulley 104*b* (FIGS. 1A, 3A, and 4A) and let out at least a portion of the second end segment of the draw cable 16 when the bow 10 is drawn (which causes the second pulley member 100*b* to rotate about its pulley member rotation axis 102*b*; FIGS. 1B, 3B, and 4B), (ii) receive at least a portion of an intermediate segment 20*b* of the secondary cable 20 in a circumferential journal of the second take-up pulley 106*b* (FIGS. 1A, 3A, and 4A) and take up at least a portion of the intermediate segment 20*b* of the secondary cable 20 when the bow 10 is drawn (FIGS. 1B, 3B, and 4B), and (iii) receive at least a portion of the intermediate segment 20*b* of the secondary cable 20 in a circumferential journal of the second let-out pulley 108*b* (FIGS. 1A, 3A, and 4A) and let out at least a portion of the intermediate segment 20*b* of the secondary cable 20 when the bow 10 is drawn (FIGS. 1B, 3B, and 4B).

The second pulley member 100*b* engages the intermediate segment 20*b* of the secondary cable 20 so as to substantially prevent slippage thereof in the respective journals of the second take-up and let-out pulleys 106*b*/108*b*. The first end segment 20*a*, the intermediate segment 20*b*, and the second end segment 20*c* of the secondary cable 20 together comprise a single continuous length of cable. Preventing such slippage is desirable for maintaining the pulley members 100*a*/100*b* substantially synchronized in their respective rotations as the bow is drawn, which in turn maintains substantially straight travel of the nock portion of the draw cable 16 as the bow 10 is drawn and then released. Slippage of the secondary cable 20 in any of the journals in which it is received disturbs the synchrony of the rotation of the pulley members 100*a*/100*b*, non-linear movement of the nock portion of the draw cable 16, and inaccurate flight or reduced speed of an arrow shot by the bow 10. The engagement of the various segments of the secondary cable 20 with the pulley members 100*a*/100*b* is described further below.

If the bow 10 is arranged as a so-called binary cam bow (FIGS. 1A/1B, 2A/2B, and 3A/3B), then the first and second pulley assemblies 100*a*/100*b* are substantially identical or substantial mirror images of each other. That symmetry results in equal and opposite rotation of the pulley members 100*a*/100*b* and substantially straight travel of the nock portion of the draw cable 16 as the bow 10 is drawn (assuming proper rotational synchronization of the pulley members 100*a*/100*b*, discussed above). The first end segment 20*a* and a portion of the intermediate segment 20*b* of the secondary cable 20 are arranged as a first power cable that is taken up by the first take-up pulley 106*a* and let-out by the let-out pulley 108*b* of the second pulley member 100*b* when the bow 10 is drawn. Similarly, the second end segment 20*c* and a portion of the intermediate segment 20*b* of the secondary cable 20 are arranged as a second power cable that is taken up by the second take-up pulley 106*b* and let out by the let-out pulley 108*a* of the first pulley member 100*a* when the bow 10 is drawn. Both of the power cables thus formed are arranged so as to pull the respective pulley members 100*a*/100*b* toward one another as the bow 10 is drawn, deforming the bow limbs 14*a*/14*b* toward one another and storing energy in the drawn bow according to the draw force curve resulting from the shapes of the pulleys 104*a*/104*b*, 106*a*/106*b*, and 108*a*/108*b*.

If the bow 10 is arranged as a so-called hybrid cam bow (FIGS. 4A/4B), then the first and second pulley members 100*a*/100*b* differ from each other. The first end segment 20*a* and a portion of the intermediate segment 20*b* of the secondary cable 20 are arranged as a synchronization cable that is taken up by the first take-up pulley 106*a* and let-out by the let-out pulley 108*b* of the first pulley member 100*b* when the bow 10 is drawn. The second end segment 20*c* and a portion of the intermediate segment 20*b* of the secondary cable 20 are arranged as a power cable that is taken up by the second take-up pulley 106*b*; the second end segment 20*c* is coupled (directly or indirectly) to the first bow limb 14*a* in any suitable way (e.g., to an axle of the first pulley member 100*a* or directly to the bow limb 14*a*, using a split bus cable arrangement, a clevis or harness, or other suitable coupling arrangement). The power cable thus formed is arranged so as to pull the second pulley member 100*b* toward the first bow limb 14*a* as the bow 10 is drawn, deforming the bow limbs 14*a*/14*b* toward one another and storing energy in the drawn bow according to the draw force curve resulting from the shapes of the pulleys 104*b* and 106*b*. The synchronization cable thus formed maintains proper synchronization of the rotation of the pulley members 100*a*/100*b* and substantially straight travel of the nock portion of the draw cable 16 resulting from the shapes of the pulleys 104*a*/104*b*, 106*a*, and 108*b*.

Engagement of the second pulley member 100*b* with the intermediate segment 20*b* of the secondary cable 20 can be implemented in any suitable way. In one example, a simple clamp 110 can be employed to clamp the intermediate segment 20*b* of the secondary cable 20 to the second pulley member 100*b* (FIGS. 1A/1B, 3A/3B, and 4A/4B). In another example, the intermediate segment 20*b* of the secondary cable 20 forms one or more full loops around an anchor post on the second pulley member 100*b*. The increased friction provided by that looping (e.g., according to the capstan equation) serves to engage the second pulley member 100*b* with the intermediate segment 20*b* of the secondary cable 20. In still another example, the intermediate segment 20*b* of the secondary cable 20 forms one or more full loops around the second let-out pulley 108*b* (FIGS. 1A/1B, 3A/3B, and 4A/4B). The increased friction provided by those one or more loops around the second let-out pulley 108*b* (e.g., according to the capstan equation) serves to engage the second pulley member 108*b* with the intermediate segment 20*b* of the secondary cable 20. In still another example, the intermediate segment 20*b* of the secondary cable 20 includes an integrally formed loop (i.e., an in-line loop) positioned around an anchor post on the second pulley member 100*b*. In still another example, the intermediate segment 20*b* of the secondary cable 20 includes a knot or other integrally formed, transversely enlarged member (i.e., an in-line ball) positioned within a socket on the second pulley member 100*b*.

Two or more arrangements such as those described above can be implemented in any suitable combination to provide non-slipping engagement of the second pulley member 100*b* with the intermediate segment 20*b* of the secondary cable 20. For example, in the embodiments depicted, a full loop of the intermediate segment 20*b* of the secondary cable 20 around the second let-out pulley 108*b* is employed along with a clamp 110. Other such combinations can be employed.

Even if another arrangement is employed for providing non-slipping engagement of the intermediate segment 20*b* of the secondary cable 20 with the second let-out pulley 108*b*, it may be nevertheless desirable to provide one or more loops of the intermediate segment 20*b* of the secondary cable 20 around the second let-out pulley 108*b*, in order to maintain contact (and desired movement of the secondary cable 20) between the secondary cable 20 and the second let-out pulley 108*b* as the second pulley member 100*b* rotates and a portion of the intermediate segment 20*b* of the secondary cable 20 is let out from the journal of the second let-out pulley 108*b* as the bow 10 is drawn. Such an arrangement is depicted in the disclosed example embodiments, as noted in the preceding paragraph. A pulley member having one or more full loops of a cable around it can be suitably arranged to accommodate those loops by having a circumferential journal in a spiral arrangement.

In the example embodiments shown, the single continuous length of the secondary cable 20 comprises a single continuous linear length of cable having first and second ends thereof (i.e., not a closed loop but an open segment). Each one of the first and second ends is anchored independently to the first pulley member 100*a* to provide engagement of the first pulley member 100*a* with the first and second end segments 20*a*/20*c* of the secondary cable 20, e.g., by a having terminal loops of the secondary cable 20 around mounting posts 112 on the first pulley member 100*a*.

In other examples, the single continuous length of the secondary cable 20 comprises a single continuous closed loop of cable. The (connected) first and second end segments 20*a*/20*c* of the secondary cable 20 can be engaged with the first pulley member 100*a* in any manner similar to those described above for engaging the intermediate segment 20*b* with the second pulley member 100*b* to substantially prevent slippage of the secondary cable 20 relative to the first pulley member 100*a* (e.g., a clamp, one or more full loops around a pulley or an anchor post, an in-line loop on an anchor post, or an in-line ball received within a socket). In a binary cam bow with a let-out pulley 108*a* on the first pulley member 100*a*, the first or second end segment 20*a*/20*c* of the secondary cable 20 can form one or more full loops around the first let-out pulley 108*a*. That arrangement also can be implemented so as to maintain contact (and desired movement of the secondary cable 20) between the secondary cable 20 and the first let-out pulley 108*a* as the first pulley member 100*a* rotates and a portion of the second end segment 20*c* of the secondary cable 20 is let out from the journal of the first let-out pulley 108*a* as the bow 10 is drawn (whether the secondary cable 20 is a linear length or a closed loop). Any suitable combination of the preceding arrangements can be employed.

Use of a single, continuous secondary cable 20 can provide several advantages, some of which may be particularly relevant to an end user of the bow 10. Mechanical characteristics of bow cables can vary from lot to lot, particularly the aging characteristics of the cables, which might stretch with time and use to differing degrees. By using a single, continuous secondary cable 20, those characteristics evolve in the same way for all cables formed by the secondary cable 20 (i.e., both power cables of a binary cam bow, or both power and synchronization cables in a hybrid cam bow). A single secondary cable 20 has only two ends to connect to a pulley member where length adjustments would be made (typically by applying half-twists to the cable), instead of four ends to connect if two separate cables are employed, simplifying installation and adjustment by the user.

A method for rigging a binary cam bow (FIGS. 1A through 3B) comprises: (A) engaging the intermediate segment 20*b* of the secondary cable 20 with the second pulley member 100*b* (via clamp 110, loops, anchors, or other), the circumferential journal of the second take-up pulley 106*b*, and the let-out pulley 108*b* of the second pulley member 100*b*; (B) engaging the first end segment 20*a* of the secondary cable 20 with the circumferential journal of the first take-up pulley 106*a*; and (C) engaging the second end segment 20*c* of the secondary cable 20 with the let-out pulley 108*a* of the first pulley member 100*a*.

A method for rigging a hybrid cam bow (FIGS. 4A/4*b*) comprises: (A) engaging the intermediate segment 20*b* of the secondary cable 20 with the second pulley member 100*b*, the circumferential journal of the second take-up pulley 106*b*, and the let-out pulley 108*b*; (B) engaging the first end segment 20*a* of the secondary cable 20 with the circumferential journal of the first take-up pulley 106*a*; and (C) coupling the second end segment 20*c* of the secondary cable 20 to the first bow limb 14*a*.

In addition to the preceding, the following examples fall within the scope of the present disclosure or appended claims:

Example 1

A compound archery bow comprising a central riser, first and second bow limbs attached to opposing end portions of the riser, first and second pulley members rotatably mounted on the first and second bow limbs, respectively, so as to define respective first and second pulley member transverse rotation axes, a draw cable, and a secondary cable, wherein: (a) the first pulley member comprises a first draw cable pulley and a first take-up pulley substantially rigidly attached to the first draw cable pulley, and is structurally arranged so as to (i) let out from a circumferential journal of the first draw cable pulley the draw cable when the bow is drawn, thereby causing the first pulley member to rotate about the first pulley member rotation axis, and (ii) take up into a circumferential journal of the first take-up pulley at least a portion of a first end segment of the secondary cable when the bow is drawn; (b) the second pulley member comprises a second draw cable pulley, a second take-up pulley substantially rigidly attached to the second draw cable pulley, and a let-out pulley substantially rigidly attached to the second draw cable pulley, and is structurally arranged so as to (i) let out from a circumferential journal of the second draw cable pulley the draw cable when the bow is drawn, thereby causing the second pulley member to rotate about the second pulley member rotation axis, (ii) take up into a circumferential journal of the second take-up pulley at least a portion of an intermediate segment of the secondary cable when the bow is drawn, and (iii) let out from a circumferential journal of the let-out pulley at least a portion of the intermediate segment of the secondary cable when the bow is drawn; (c) a second end segment of the secondary cable is coupled to the first bow limb or the first pulley member, and the first end segment, the intermediate segment, and a second end segment of the secondary cable together comprise a single continuous length of cable; and (d) the second pulley member engages the intermediate segment of the secondary cable so as to substantially prevent slippage thereof in the respective journals of the second take-up pulley and the let-out pulley.

Example 2

The bow of Example 1 wherein the intermediate segment of the secondary cable is clamped to the second pulley member, thereby engaging the second pulley member with the intermediate segment of the secondary cable.

Example 3

The bow of any one of Examples 1 or 2 wherein the intermediate segment of the secondary cable forms one or more full loops around an anchor post on the second pulley member, thereby engaging the second pulley member with the intermediate segment of the secondary cable.

Example 4

The bow of any one of Examples 1 through 3 wherein the intermediate segment of the secondary cable forms, with the bow at brace, one or more full loops around the second let-out pulley.

Example 5

The bow of Example 4 wherein the one or more full loops around the second let-out pulley provide engagement of the second pulley member with the intermediate segment of the secondary cable.

Example 6

The bow of any one of Examples 1 through 5 wherein the second pulley member includes an anchor post, and the intermediate segment of the secondary cable includes an in-line loop positioned around the anchor post, thereby providing engagement of the second pulley member with the intermediate segment of the secondary cable.

Example 7

The bow of any one of Examples 1 through 6 wherein the second pulley member includes a socket, and the intermediate segment of the secondary cable includes an in-line, transversely enlarged member positioned within the socket, thereby providing engagement of the second pulley member with the intermediate segment of the secondary cable.

Example 8

The bow of any one of Examples 1 through 7 wherein the single continuous length of cable comprises a single continuous linear length of cable having first and second ends thereof, and each one of the first and second ends is anchored independently to the first pulley member, thereby engaging the first pulley member with the first and second end segments of the secondary cable.

Example 9

The bow of Example 8 wherein the second end segment of the secondary cable forms, with the bow at brace, one or more full loops around a let-out pulley of the first pulley member.

Example 10

The bow of any one of Examples 8 or 9 wherein the first end segment of the secondary cable terminates in a first end loop around a first anchor post on the first pulley member or the first bow limb, and the second end segment of the secondary cable terminates in a second end loop around a second anchor post on the first pulley member.

Example 11

The bow of any one of Examples 1 through 7 wherein the single continuous length of cable comprises a single continuous closed loop of cable, and the first pulley member engages the first end segment of the secondary cable so as to substantially prevent slippage thereof in the journal of the first take-up pulley.

Example 12

The bow of Example 11 wherein the first or second end segment of the secondary cable is clamped to the first pulley member, thereby engaging the first pulley member with the first and second end segments of the secondary cable.

Example 13

The bow of any one of Examples 11 or 12 wherein the first or second end segment of the secondary cable forms one or more full loops around an anchor post on the first pulley member, thereby engaging the first pulley member with the first and second end segments of the secondary cable.

Example 14

The bow of any one of Examples 11 through 13 wherein the first or second end segment of the secondary cable forms, with the bow at brace, one or more full loops around the first let-out pulley.

Example 15

The bow of Example 14 wherein the one or more full loops around the first let-out pulley provide engagement of the first pulley member with the first and second end segments of the secondary cable.

Example 16

The bow of any one of Examples 1 through 15 wherein: (e) the first pulley member further comprises a let-out pulley substantially rigidly attached to the first draw cable pulley and the first pulley member is further structurally arranged so as to let out from a circumferential journal of the let-out pulley of the first pulley member at least a portion of the second end segment of the secondary cable when the bow is drawn, thereby coupling the second end segment of the secondary cable to the first pulley member; (f) the first end segment and a portion of the intermediate segment of the secondary cable are arranged as a first power cable that is taken up by the first take-up pulley and let-out by the let-out pulley of the second pulley member when the bow is drawn; and (g) the second end segment and a portion of the intermediate segment of the secondary cable are arranged as a second power cable that is taken up by the second take-up pulley and let out by the let-out pulley of the first pulley member when the bow is drawn.

Example 17

A method for rigging the bow of Example 16, the method comprising: (A) engaging the intermediate segment of the secondary cable with the second pulley member, the circumferential journal of the second take-up pulley, and the let-out pulley of the second pulley member; (B) engaging the first end segment of the secondary cable with the circumferential journal of the first take-up pulley; and (C) engaging the second end segment of the secondary cable with the let-out pulley of the first pulley member.

Example 18

The bow of any one of Examples 1 through 15 wherein: (e) the first end segment and a portion of the intermediate segment of the secondary cable are arranged as a synchronization cable that is taken up by the first take-up pulley and let-out by the let-out pulley when the bow is drawn; and (f) the second end segment and a portion of the intermediate segment of the secondary cable are arranged as a power cable that is coupled to the first bow limb and taken up by the second take-up pulley when the bow is drawn.

Example 19

A method for rigging the bow of Example 18, the method comprising: (A) engaging the intermediate segment of the secondary cable with the second pulley member, the circumferential journal of the second take-up pulley, and the let-out pulley; (B) engaging the first end segment of the secondary cable with the circumferential journal of the first take-up pulley; and (C) coupling the second end segment of the secondary cable to the first bow limb.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Thus, the appended claims are hereby incorporated into the Detailed Description, with each claim standing on its own as a separate disclosed embodiment. However, the present disclosure shall also be construed as implicitly disclosing any embodiment having any suitable set of one or more disclosed or claimed features (i.e., a set of features that are neither incompatible nor mutually exclusive) that appear in the present disclosure or the appended claims, including those sets that may not be explicitly disclosed herein. In addition, for purposes of disclosure, each of the appended dependent claims shall be construed as if written in multiple dependent form and dependent upon all preceding claims with which it is not inconsistent. It should be further noted that the scope of the appended claims does not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure and appended claims, the words "comprising," "including," "having," and variants thereof, wherever they appear, shall be construed as open ended terminology, with the same meaning as if the phrase "at least" were appended after each instance thereof, unless explicitly stated otherwise.

In the appended claims, if the provisions of 35 USC §112(f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A compound archery bow comprising a central riser, first and second bow limbs attached to opposing end portions of the riser, first and second pulley members rotatably mounted on the first and second bow limbs, respectively, so as to define respective first and second pulley member transverse rotation axes, a draw cable, and a secondary cable, wherein:

(a) the first pulley member comprises a first draw cable pulley and a first take-up pulley substantially rigidly attached to the first draw cable pulley, and is structurally arranged so as to (i) let out from a circumferential journal of the first draw cable pulley the draw cable when the bow is drawn, thereby causing the first pulley member to rotate about the first pulley member rotation axis, and (ii) take up into a circumferential journal of the first take-up pulley at least a portion of a first end segment of the secondary cable when the bow is drawn;

(b) the second pulley member comprises a second draw cable pulley, a second take-up pulley substantially rigidly attached to the second draw cable pulley, and a let-out pulley substantially rigidly attached to the second draw cable pulley, and is structurally arranged so as to (i) let out from a circumferential journal of the second draw cable pulley the draw cable when the bow is drawn, thereby causing the second pulley member to rotate about the second pulley member rotation axis, (ii) take up into a circumferential journal of the second take-up pulley at least a portion of an intermediate segment of the secondary cable when the bow is drawn, and (iii) let out from a circumferential journal of the let-out pulley at least a portion of the intermediate segment of the secondary cable when the bow is drawn;

(c) a second end segment of the secondary cable is coupled to the first bow limb or the first pulley member, and the first end segment, the intermediate segment, and the second end segment of the secondary cable together comprise a single continuous length of cable; and (d) the second pulley member engages the intermediate segment of the secondary cable so as to substantially prevent slippage thereof in the respective journals of the second take-up pulley and the let-out pulley.

2. The bow of claim 1 wherein:

(e) the first pulley member further comprises a let-out pulley substantially rigidly attached to the first draw cable pulley and the first pulley member is further structurally arranged so as to let out from a circumferential journal of the let-out pulley of the first pulley member at least a portion of the second end segment of the secondary cable when the bow is drawn, thereby coupling the second end segment of the secondary cable to the first pulley member;

(f) the first end segment and a portion of the intermediate segment of the secondary cable are arranged as a first power cable that is taken up by the first take-up pulley and let-out by the let-out pulley of the second pulley member when the bow is drawn; and (g) the second end segment and a portion of the intermediate segment of the secondary cable are arranged as a second power cable that is taken up by the second take-up pulley and let out by the let-out pulley of the first pulley member when the bow is drawn.

3. A method for rigging the bow of claim 2, the method comprising:

(A) engaging the intermediate segment of the secondary cable with the second pulley member, the circumferential journal of the second take-up pulley, and the let-out pulley of the second pulley member;

(B) engaging the first end segment of the secondary cable with the circumferential journal of the first take-up pulley; and (C) engaging the second end segment of the secondary cable with the let-out pulley of the first pulley member.

4. The bow of claim 1 wherein:

(e) the first end segment and a portion of the intermediate segment of the secondary cable are arranged as a synchronization cable that is taken up by the first take-up pulley and let-out by the let-out pulley when the bow is drawn; and (f) the second end segment and a portion of the intermediate segment of the secondary cable are arranged as a power cable that is coupled to the first bow limb and taken up by the second take-up pulley when the bow is drawn.

5. A method for rigging the bow of claim 4, the method comprising:

(A) engaging the intermediate segment of the secondary cable with the second pulley member, the circumferential journal of the second take-up pulley, and the let-out pulley;

(B) engaging the first end segment of the secondary cable with the circumferential journal of the first take-up pulley; and (C) coupling the second end segment of the secondary cable to the first bow limb.

6. The bow of claim 1 wherein the intermediate segment of the secondary cable is clamped to the second pulley member, thereby engaging the second pulley member with the intermediate segment of the secondary cable.

7. The bow of claim 1 wherein the intermediate segment of the secondary cable forms one or more full loops around an anchor post on the second pulley member, thereby engaging the second pulley member with the intermediate segment of the secondary cable.

8. The bow of claim 1 wherein the intermediate segment of the secondary cable forms, with the bow at brace, one or more full loops around the second let-out pulley.

9. The bow of claim 8 wherein the one or more full loops around the second let-out pulley provide engagement of the second pulley member with the intermediate segment of the secondary cable.

10. The bow of claim 1 wherein the second pulley member includes an anchor post, and the intermediate segment of the secondary cable includes an in-line loop positioned around the anchor post, thereby providing engagement of the second pulley member with the intermediate segment of the secondary cable.

11. The bow of claim 1 wherein the second pulley member includes a socket, and the intermediate segment of the secondary cable includes an in-line, transversely enlarged member positioned within the socket, thereby providing engagement of the second pulley member with the intermediate segment of the secondary cable.

12. The bow of claim 1 wherein the single continuous length of cable comprises a single continuous linear length of cable having first and second ends thereof, and each one of the first and second ends is anchored independently to the first pulley member, thereby engaging the first pulley member with the first and second end segments of the secondary cable.

13. The bow of claim 12 wherein the second end segment of the secondary cable forms, with the bow at brace, one or more full loops around a let-out pulley of the first pulley member.

14. The bow of claim 12 wherein the first end segment of the secondary cable terminates in a first end loop around a first anchor post on the first pulley member or the first bow limb, and the second end segment of the secondary cable terminates in a second end loop around a second anchor post on the first pulley member.

15. The bow of claim 1 wherein the single continuous length of cable comprises a single continuous closed loop of cable, and the first pulley member engages the first end segment of the secondary cable so as to substantially prevent slippage thereof in the journal of the first take-up pulley.

16. The bow of claim 15 wherein the first or second end segment of the secondary cable is clamped to the first pulley member, thereby engaging the first pulley member with the first and second end segments of the secondary cable.

17. The bow of claim 15 wherein the first or second end segment of the secondary cable forms one or more full loops around an anchor post on the first pulley member, thereby engaging the first pulley member with the first and second end segments of the secondary cable.

18. The bow of claim 15 wherein the first or second end segment of the secondary cable forms, with the bow at brace, one or more full loops around the first let-out pulley.

19. The bow of claim 18 wherein the one or more full loops around the first let-out pulley provide engagement of the first pulley member with the first and second end segments of the secondary cable.

* * * * *